United States Patent [19]

Dembiak et al.

[11] 4,109,099

[45] Aug. 22, 1978

[54] DUAL JACKETED CABLE

[75] Inventors: Matthew Raymond Dembiak, Clifton, N.J.; Wayne McCall Newton, Lilburn, Ga.

[73] Assignee: Western Electric Company, Incorporated, New York, N.Y.

[21] Appl. No.: 857,716

[22] Filed: Dec. 5, 1977

Related U.S. Application Data

[63] Continuation of Ser. No. 655,360, Feb. 5, 1976, abandoned.

[51] Int. Cl.[2] ..... H01B 7/28

[52] U.S. Cl. ..... 174/107; 174/120 SR

[58] Field of Search ..... 174/107, 102 D, 106 D, 174/120 R, 120 AR, 120 SR, 110 PM, 110 AR, 36, 23 R

[56] References Cited

U.S. PATENT DOCUMENTS

| | | | |
|---|---|---|---|
| 3,485,938 | 12/1969 | Kingsley | 174/107 |
| 3,638,306 | 2/1972 | Padowicz | 174/107 X |
| 3,790,694 | 2/1974 | Portinari | 174/121 SR |
| 3,943,271 | 3/1976 | Bahder et al. | 174/102 D |
| 3,964,945 | 6/1976 | Everhart et al. | 174/110 PM |
| 4,008,368 | 2/1977 | Leuchs | 174/120 AR |
| 4,034,153 | 7/1977 | Andres et al. | 174/120 R |

FOREIGN PATENT DOCUMENTS

| | | | |
|---|---|---|---|
| 838,298 | 3/1970 | Canada | 174/107 |
| 2,108,673 | 9/1971 | Fed. Rep. of Germany | 174/107 |

*Primary Examiner*—J. V. Truhe
*Assistant Examiner*—J. H. Bouchard
*Attorney, Agent, or Firm*—E. W. Somers

[57] ABSTRACT

A plastic jacketed cable; having a corrugated metallic shield which encloses a core comprising a plurality of insulated conductors, for use in underground ducts exposed to elevated temperatures includes an inner jacket which is capable of providing and maintaining adequate strength properties notwithstanding imprinting thereof by the corrugations of the shield contiguous thereto, and an outer jacket superimposed over the inner jacket and suitable for resisting degradation while being exposed to the elevated temperatures for sustained periods of time.

6 Claims, 6 Drawing Figures

DUAL JACKETED CABLE

This is a continuation of application Ser. No. 655,360, now abandoned, filed Feb. 5, 1976.

BACKGROUND OF THE INVENTION

1. Field of the Invention

This invention relates to a dual jacketed cable, and, more particularly, to a cable having a corrugated metallic layer overlying the core, an outer jacket of a material capable of withstanding elevated temperatures, and an inner jacket which is interposed between the metallic layer and the outer jacket and which is capable of withstanding effects of corrugation imprint.

2. Description of the Prior Art

In metropolitan areas it is not uncommon to run communications cable in underground ducts which are located adjacent to steam lines. Because the steam lines may have an adverse affect on the communications cable, it is incumbent upon cable manufacturers to provide a cable having a jacket which is capable of withstanding elevated temperatures.

In the past, polyethylene-jacketed, lead shielded cables were used in these environments. Not only was this arrangement very costly, but the outer layer of polyethylene, when exposed to high temperatures for a long period of time, tended to develop cracks. Cables having a polyethylene jacket extruded over a soldered seam steel shield have also been used. However, in cables of this latter construction, the soldered seam is not generally continuous. Since cables of this type are usually under a slight gas pressure, e.g., 10 p.s.i., the discontinuities in the sealed seam causes the gas pressure to be exerted on the polyethylene jacket which may cause degradation of the jacket.

One prior art design includes a cable core having a corrugated metallic layer for purposes of withstanding stresses due to the bending of the cable during installation, and a jacket comprised of a polybutylene material covering the metallic layer. While the polybutylene material was capable of withstanding those kinds of temperatures destined to be encountered in the underground duct system, it was also found that the polybutylene exhibits reduced stress-resisting capability because of the corrugation imprint from the metallic layer. As a result, it was not uncommon for the outer jacket to crack during the installation of the cable when it was bent in a curved configuration with rather sharp radius bends. The corrugation imprint caused the reduced thickness of the cable jacket to be rendered incapable of withstanding the stress encountered. This problem becomes more acute during cold weather installation since the mechanical properties of polybutylene begin to change below a temperature of approximately 40° F.

Another one of the problems which was encountered in cable in which a single polybutylene jacket was applied directly over the metallic layer related to the curing time for the polybutylene which typically may be in the range of 14 days. Within 4 days, for example, the density changes from 0.88 grams/cc to 0.91 grams/cc. And since the polybutylene jacket engages is in engagement with the corrugations, it shrinks and becomes spaced from the corrugations, nonuniformly along the contour of the corrugations.

After the jacket is extruded over the corrugated metal layer and cooled, the cable is taken up on a reel which causes a tightening up of the cable. The curing of the polybutylene jacket after the cable is wound on the reel coupled with the pressure of the successive layers causes the corrugations of the metallic layer to penetrate further into the polybutylene if the polybutylene lies in direct engagement with the corrugated metallic layer. This exaggerated corrugation imprint results in localized thinness of the jacket adjacent the peaks of the corrugations with an accompanying tensioning of the polybutylene in the area of penetration.

Unfortunately, this further imprinting of the prior art single jacket, steam-resistant cables occured after the cable had been wound on the reel and hence subsequent to the conventional in-line jacket thickness testing. This lead to the anomalous situation where in line tests indicated an acceptable jacket thickness of a cable, but where at the point of the use the cable had unacceptable thin jacket.

Further, if, as is usually the case, the above-described cable is wound on a reel during the transition curing period of the polybutylene, the cable is said to develop a "reel set". The installation and attendant bending of a cable having "reel set" requires more strain with increased probability of jacket buckling. Moreover, the extrusion jacketing of a cable core establishes a weld line which tends to cause a longitudinal splitting of the jacket. The adverse effects caused by a polybutylene jacket contiguous to the corrugated metallic shield may aggravate this tendency to split longitudinally.

Because of the demand for this type cable in large metropolitan areas and because of the importance of maintaining the integrity of the cable during the installation and thereafter, efforts have been devoted toward overcoming the problems of exposure to elevated temperatures while maintaining the structural integrity of the cable during the bending and installation thereof.

SUMMARY OF THE INVENTION

With these and other objects in mind, the present invention contemplates a cable which comprises the core, a corrugated metallic layer, having inwardly and outwardly facing major surfaces surrounding the core with, the inwardly facing major surface facing the core, and an extruded covering of polymeric material surrounding the metallic layer. The extruded covering includes an inner jacket being in intimate contact with the metallic layer and interposed between the metallic layer and an outer jacket extruded over and in intimate contact with the inner jacket. The outer jacket is constructed of a material which is capable of withstanding exposure to temperatures of at least 212° F and the material of the inner jacket has a notch sensitivity substantially less than that of the material of the outer jacket to maintain substantially the structural integrity of the cable notwithstanding corrugation imprint thereof by the metallic layer. Further, the inner jacket having a thickness which is at least slightly greater than the depth of the corrugations of the metallic layer.

More particularly, a cable constructed in accordance with the pinciples of the invention includes a core which comprises a plurality of insulated conductors, a first corrugated metallic shield having inwardly and outwardly facing surfaces surrounding the core with the inwardly facing major surface facing the core, and a second corrugated metallic shield having inwardly and outwardly facing major surfaces superimposed on the first shield, with the inwardly facing major surface facing the first shield and with longitudinal portions of the major facing surfaces forming a longitudinal seam which is soldered and a flooding compound coated over the second shield to fill partially the corrugations thereof. A first polymeric which is extruded over the second shield and in intimate contact therewith has a thickness which is at least slightly greater than the depth of the corrugations of the second shield, and is constructed of a polymeric material having a notch sensitivity of a value substantially small enough that the structural integrity of the cable is maintained notwithstanding the intrusion of the corrugations of the metallic shield into the polyethylene layer. An outer jacket of a second polymeric material which is extruded over and in intimate contact with but not chemically bonded to the inner jacket is constructed of material such as polybutylene which is capable of withstanding exposure to temperatures of at least 212° F.

BRIEF DESCRIPTION OF THE DRAWINGS

Other features of the present invention will be more readily understood in the following detailed description of specific embodiments thereof when read in conjunction with the accompanying drawings, in which.

DETAILED DESCRIPTION OF THE DRAWINGS

Figure 1:
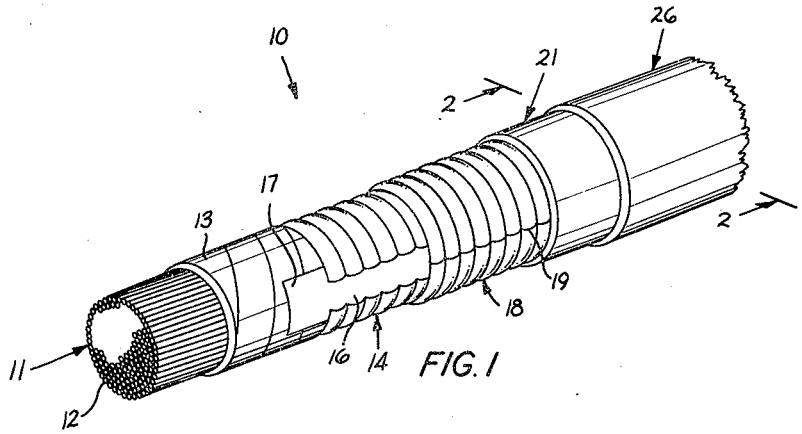
FIG. 1 is a perspective view of a cable constructed in accordance with the principles of this invention and showing a core, two metallic layers, an inner jacket and an outer jacket overlying the inner jacket.
Figure 2:
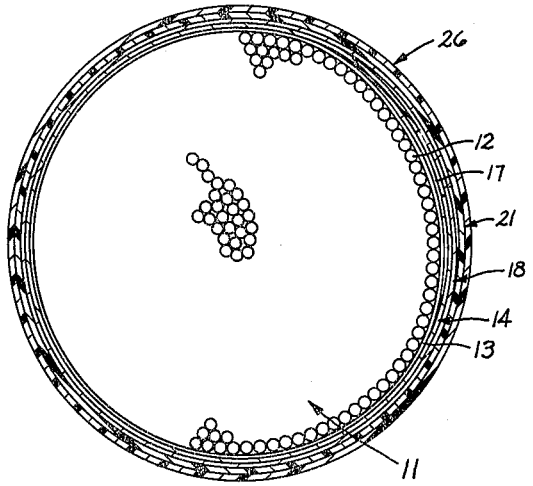
FIG. 2 is a cross-sectional view of the cable of FIG. 1 and taken along lines 2—2.

Referring now to FIGS. 1 and 2, there is shown a cable, designated generally by the numeral 10, constructed in accordance with the principles of this invention. Cables of this type are designated by the acronym "STEAMPETH" and are installed in ducts which typically may be adjacent steam lines in underground urban locations. The cable 10 comprises a core, designated generally by the numeral 11, which comprises a plurality of individually insulated conductors 12—12. The insulation material of the conductors typically is pulp or a plastic material such as, for example, polypropylene. A core wrap tape 13 is applied helically about the core 11 and typically is made of paper for pulp insulated conductor cores or a REEMAY® polyester, for example, for plastic insulated conductor cores.

Surrounding the core is a metallic layer, designated generally by the numeral 14, which is comprised, for example, of a material such as aluminum which is corrugated and then formed to a tubular shape about the cable core 11. The corrugations of the metallic layer 14 are transverse of the center line of the cable core and may be varied as to the depth thereof and the number of corrugations per lineal distance along the cable shield. Generally, the aluminum shield 14 is wrapped longitudinally about the cable core 11 such that the longitudinal edges form an essentially butt seam 16 with a slight gap therebetween. As can best be seen in FIG. 1, a strip 17 of material such as, for example, a paper tape, is inserted under the seam 16 to act as a heat barrier to protect the core 11 during subsequent steps of the manufacturing process. The tape strip 17 may also be an aluminum-kraft paper-Mylar laminate referred to as AKM.

The cable 10 also includes a corrugated metallic layer 18 which conventionally is constructed of steel in order to provide the cable with mechanical protection. Longitudinal edge portions of the corrugated steel layer 18 are generally in superimposed relation to each other to form an overlapped seam 19. Preferably, the overlapping portions of the layer 18 are soldered together to provide an effective barrier to moisture ingress. The corrugated metal layer 18 is covered with a corrosion preventive flooding material 20 (see FIG. 3) which prevents corrosion of the steel layer 18 and moisture diffusion into the cable core 11 by flooding the soldered seam which may have occasional openings therein.

Figure 3:
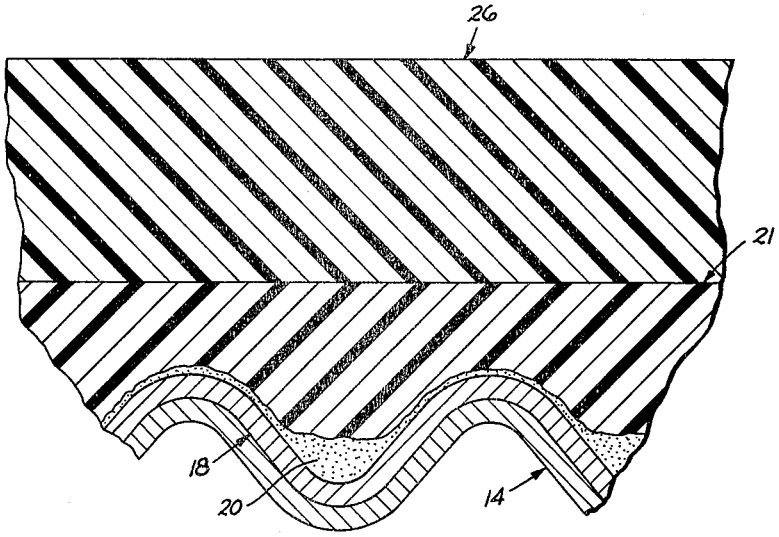
FIG. 3 is a detailed enlarged view of a portion of the cable shown in FIG. 1 and showing the intrusion of the corrugated metal shield into the inner jacket with the outer jacket extruded over the inner jacket.

Typically, in the cable, the depth of the corrugations is in the range of 42 mils. As can be seen in FIG. 3, a thermoplastic flooding compound 20 (commonly referred to as TPC) and preferably of an asphalt-tar material, is coated over the outer corrugated metallic layer 18 so as to fill partially the corrugations thereof. Typically, the flooding compound fills approximately one-half the depth of the corrugations. It has been found that an atactic polypropylene petroleum jelly may also be used for the flooding compound.

The cable 10 also includes an inner jacket, designated generally by the numeral 21, overlying and in intimate contact with the coated metallic layer 18. The inner jacket 21 is constructed of a polymeric material such as, for example, a high molecular weight low density polyethylene typically of 0.92 specific gravity which has excellent strength characteristics and in other types of communications cables comprises the only jacket. Such a material ia available commercially, for example, from E. I. DuPont de Nemours and Company under the designation ALATHON 1250, from the Dow Chemical Company under the designation PE 862, from the Union Carbide Company under the designation DFDC 0506 or from the Sinclair-Koppers Company under the designation DYLAN 3900W. Typically, the low density polyethylene has a melt index of approximately 0.26, a carbon concentration of 2.55%, a swelling ratio of 1.19 and a tensile yield of 1282 p.s.i. and an ultimate elongation of 780%.

The inner jacket 21 must be applied over the metallic layer 18 such that the distance measured radially from the longitudinal axis of the cable 10 to the outwardly facing surface of the inner jacket is at least slightly greater, e.g., several mils, greater than the corresponding distance to the outermost portion of the corrugations. This requirement will always be met in a manufacturing environment because of the restrictions of an extrusion operation. A jacket of several mils is not an attainable goal presently because of the likelihood of openings occurring therein. Conventionally, the outwardly facing surface of the inner jacket will be in the approximate range of 28 to 42 mils beyond the corrugation peak in the size cables contemplated.

It is important that the material of the inner jacket 21 is capable of maintaining its integrity notwithstanding the protrusion thereinto of the peaks of the corrugated metallic shield 18 (see FIG. 3). The protrusion of the corrugation peaks into the contiguous plastic is commonly referred to as corrugation imprint.

In the past, when using a single jacket comprised, for example, of polybutylene, it was not uncommon to experience cracking of the jacket periodically along the length of the cable with the defective locations corresponding to the locations of process-accentuated imprint and hence thin jacket.

It has been common to measure resistance to corrugation imprint by a property related to the notch sensitivity of the material. Notch sensitivity at a given temperature is defined as that critical notch depth ratio, i.e., notch depth/unnotched sample thicknes, in a material, which causes the ultimate elongation of the material to be reduced significantly when subjected to a standard tensile test. As the critical notch depth ratio becomes smaller, a material is described as being more notch sensitive. Judged in terms of performance as a jacketing compound, a material is notch sensitive if it fractures easily at a notch depth less than 15% of the sample thickness.

In one such test, for example, of crystalline polymeric, microtensile samples per A.S.T.M. D-1708 are cut from compression molded plaques. These samples are notched by pressing a carbide steel blade into a surface of the sample with the notch being perpendicular to the long axis of the sample. The blade used to notch the samples has a 0.003 inch tip radius and a 60° included angle.

It has been found that the polybutylene material of the prior construction single jacket cable while capable of withstanding the elevated temperatures inherently possesses a notch sensitivity which is substantially greater, and less acceptable, than that which is required in order to maintain the structural integrity of the jackets during the bending and installation thereof. Low density polyethylene is a suitable material for use in constructing the inner jacket 21. Not only is it generally readily available in cable manufacturing facilities because of its widespread use as a single jacketing material, but its physical properties are ideally suited to this application. Notching of the polyethylene results in a much smaller degradation in elongation capability of the polyethylene than the material of the prior jacket, e.g., polybutylene, which bore imprinting.

The comparative notch sensitivities of polybutylene and polyethylene are demonstrated with reference to the results shown in Table I of elongation tests performed on a 75 mil thick sample at room temperature of approximately 68° F. It should be understood that percent elongation is intended to mean that a sample can be stretched that amount before it ruptures.

Table I

| Items | Elongation % | |
|---|---|---|
| | Polybutylene | Polyethylene |
| Unnotched | 390 | 625 |
| 10 mil notched | 280 | — |
| 20 mil notched | 20 | 608 |
| 25 mil notched | — | 563 |
| 30 mil notched | — | 140 |

The elongation and hence the notch sensitivity of a sample are affected by the material and the notch depth ratio. It will be observed from Table I that the polybutylene experiences a significant change in notch sensitivity in going from a notch depth of 10 mils or 13.4% of sample depth to a notch depth of 20 mils or 26.5%. This contrasts sharply with the polyethylene in which there is a sustained low notch sensitivity beyond 33% notch intrusion. In one 66 mil thick sample of polybutylene at room temperature of approximately 68° F, a 10 mil notch caused the sample to have an elongation of about 70%.

It has been found that notch sensitivity is also affected by temperature. While the ambient temperature during installation is important, the temperature of the cable 10 itself must be considered. For example, a cable 10 on a supply reel may have been exposed overnight to lower temperatures and actually be in the range of 20°–30° F in the first stages of an installation in an ambient warmed morning temperature of 40° F.

Moreover, the effect of temperature on notch sensitivity varies with the polymeric material of which the jacket is constructed. For example, the percent elongation at break for polyethylene is not affected substantially until temperatures in the range of 0° F are encountered. In contrast, the percent elongation at break for polybutylene decreases substantially below that at 40° F. For example, while the percent elongation at break for unnotched polybutylene is approximately 310% in the temperature range of 40° F to 260° F, the percent elongation drops to about 225% at 20° F.

Lastly, overlying and in intimate contact with the inner jacket 21 is an outer jacket, designated generally by the numeral 26, and being a material generally different from the material of which the inner jacket is constructed. Since the cable 10 is to be placed in an environment which typically is adjacent underground steam lines (not shown) in metropolitan area installations, the outer jacket 26 must be capable of withstanding elevated temperatures which are in the range of 212° F.

The material of the outer jacket 26 must possess certain characteristics in order to withstand damage by temperatures which range in the vicinity of 212° F. Specifically the material of the outer jacket 26, desirably, should resist rupture and excessive deformation defined in terms of a diameter increase of less than 15% at a temperature of approximately 212° F for a minimum of 20 years while containing 100 pounds per square inch of gas pressure per cable. Further, in order to prevent longitudinal splitting of the outer jacket 26 during bending thereof, the material of the outer cable jacket must have a minimum elongation across extrusion weld lines approximately 200% at 68° F. It has been found that the jacket 26 of a cable 10 constructed in accordance with the principles of this invention has an elongation across the weld line in the range of 250–350%.

For crystalline polymers advantageously useful in steam environments, yield strength measured at 212° F provides a useful test for selecting materials from which the outer jacket 26 may be constructed. In order to prevent undesirable ballooning, an acceptable material for the outer jacket 26 cannot have a yield strength below 500 p.s.i. at 212° F.

Polyethylene, for example, is not suitable as an outer jacket material, particularly in gas pressurized cables in high temperature environments. Polyethylene softens at a temperature of about 170° F and begins to balloon about the core 11 which may cause an adherence undesirably to the walls of a duct 27 (see FIG. 4A) in which the cable 10 is installed. This elongation of the polyethylene may continue until a rupture occurs. Because of the less than perfect integrity of the soldered seam, a loss in gas pressure occurs.

It has been found that polybutylene, for example, is a material which provides the cable with protection against the elevated temperatures. The polybutylene, although soft when freshly applied to the cable 10, experiences a transformation advantageously into a crystalline structure during a curing state which extends, for example, over a period of about 14 days. It has been found that the curing is about 90% complete in 10 days. The crystalline structure is believed to impart to the polybutylene the capability of withstanding exposure to steam.

A polybutylene material which has been found to be suitable for use in constructing the outer jacket 26 is one marketed by Witco Chemical Company of Fairfield, N.J., for example, under the designation WITRON 4121. This is a pipe grade polybutylene resin having a melt index of 0.4.

Advantageously, the polybutylene is helpful in maintaining a gas pressure typically in the range of 10 p.s.i. within the cable 10 at temperatures of at least 230° F. This is directly attributable to the excellent yield strength, i.e., 800-900 p.s.i. of the polybutylene at 212° F. In comparison, polyethylene has a yield strength of about 20 p.s.i. at 212° F.

A dual-jacketed cable 10 constructed in accordance with the principles of this invention and for the intended use specified hereinbefore may comprise in the range of 900 to 2700 conductor pairs with a gauge size in the range of 22 to 26. Typically, the outer jacket 26 has a thickness approximately in the range of 65 to 80 mils. The outside diameter of the completed cable 10 may be in the range, for example, of 2 to 3 inches.

The dual jackets 21 and 26 provide the cable 10 advantageously with suitable strength characteristics as well as protection for the cable in a special environment. The sealed seam 19 and the dual jackets 21 and 26 are effective in maintaining a gas pressure within the cable 10 which typically is approximately 10 p.s.i.

The novel construction of this cable provides the cable 10 with the characteristics which are necessary not only with respect to installation, for example, but also with respect to the unusual environment which with cables of this type, which have been designated STEAMPETH, are confronted. That is to say the cable 10 must have the strength characteristics which are required to maintain the integrity of the cable jacket during the installation of the cable with the cable being fed, tyically, into underground ducts 27—26 (see FIGS. 4A and 4B) with the attendant bending of the cable as well as to provide the cable with protection sufficient to withstand the elevated temperatures of the special environments. The cable 10 constructed in accordance with the principles of this invention possesses suitable strength properties notwithstanding the corrugation imprint inherent in the structure.

Figure 4A:
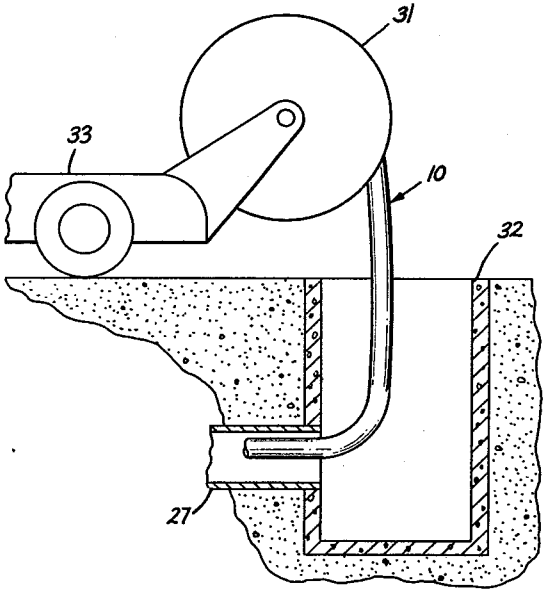
FIGS. 4A and 4B are elevational views showing a typical arrangement for installing cables in underground ducts.
Figure 4B:
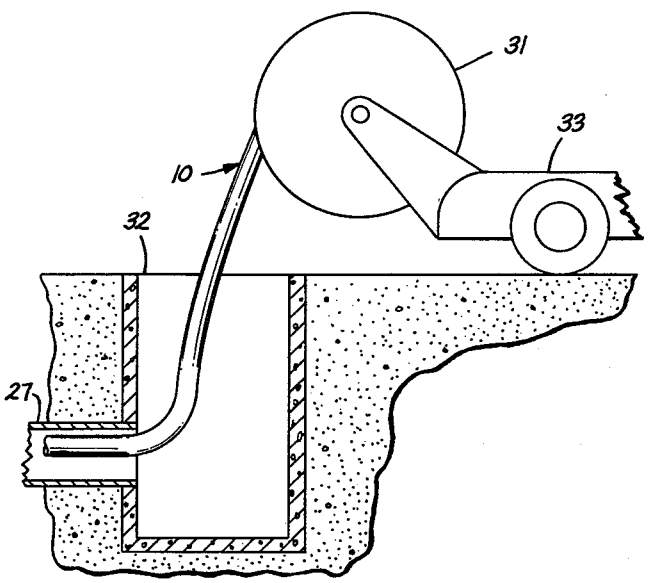

The corrugation imprint of the plastic material contiguous the steel shield 18 affects adversely the ability of the cable 10 to withstand forces imparted thereto during installation in the underground ducts 27—27. As shown in FIG. 4A, a cable reel 31 mounted on a payoff 33 is positioned adjacent a manhole 32. Successive sections of the cable 10 are unwound desirably in a configuration known as a "C" shape as shown in FIG. 4A such that portions of the cable under tension and compression on the reel experience tension and compression respectively during installation. It is not uncommon, however, for the cable 10 to be unwound from the supply reel 31 in the arrangement shown in FIG. 4B and referred to in the art as an "S" bend. There, a reverse bend is imparted to the cable 10 as successive sections are unwound from the reel 31. Hence, the outwardly facing portions of the cable 10 which were in tension on the reel 31 are subjected to compressive forces and portions in compression are subjected to tension. In those cables 10—10, for example. where corrugation imprint has resulted in a thin jacket of highly notch sensitive material such as, for example, single jacket polybutylene cables, this reverse bending tends undesirably to buckle the cable. This tendency is substantially reduced in the dual jacketed cable 10 that is constructed in accordance with the principles of this invention. Moreover, the dual jacketed cable 10 provides for a speedy recovery from any such tendency.

A cable 10 constructed in accordance with the principles of this invention may be installed successfully in cable temperatures of about 30° F and ambient temperatures as low as about 40° F. However, severe abrasion occasioned by the cable jacketing material engaging the duct 27 can cause failures during installation of cables 10—10 at temperatures of 30° F. It has been found that these failures are eliminated even in the presence of severe abrasion if the cable 10 is at approximately 40° F during installation.

It will be recalled that the extrusion jacketing of a cable core may establish a weld line which tends to cause a longitudinal splitting of the jacket. The adverse effects caused by a polybutylene jacket contiguous to the corrugated metallic shield may aggravate this above-mentioned tendency to split longitudinally. The relocation of the polybutylene jacket 26 and insulation thereof from the corrugations coupled with the use of a substantially less notch-sensitive material, e.g., low density polyethylene, being in engagement with the corrugations avoids any aggravation of this tendency.

Figure 5:
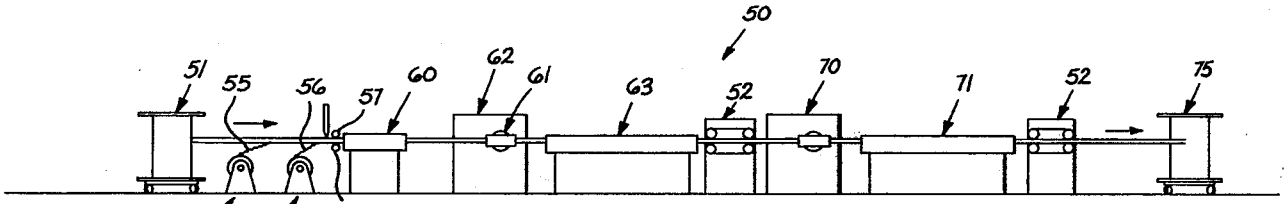
FIG. 5 is a schematic view in elevation of a manufacturing line which may be used to construct the cable in accordance with the principles of this invention and shown in FIG. 1.

Corrugation imprint is aggravated undesirably because of the process for manufacturing the cable 10. Referring now to FIG. 5, there is shown an apparatus, designated generally by the numeral 50, for enclosing the core 11. Typically, successive sections of the core 11 are payed off a supply reel 51 and advanced by capstans 52—52 in a downstream direction through a station 53 whereat a corrugated aluminum tape 55 is wrapped longitudinally about the core to form the shield 14 after which the heat barrier 17 is inserted. Subsequently, the core 11 and shield 14 are advanced through a station 54 whereat a steel tape 56 is wrapped longitudinally thereabout to form the overlapped seam 19 which is soldered. Apparatus for forming the corrugated tapes 55 and 56, for wrapping the tapes about the core and for soldering the overlapping portions of the steel tape are conventional in the art. See, for example, in U.S. Pat. Nos. 2,758,189, 2,801,316, and 2,925,485, all incorporated by reference hereinto.

The taped core 11 may be taken up on a core truck (not shown) and moved to a supply station (not shown) of another line for further processing. In a preferred embodiment, the partially completed cable 10 is advanced along the same line in tandem between a pair of rounding rollers 57—57 and then through a coating apparatus, designated generally by the numeral 60, which applies a flooding compound such as, for example, an asphalt-tar coating, over the corrugated metal shield 18 to partially fill the corrugations thereof.

Then the partially completed cable 10 is advanced through a cross head 61 of an extruder, designated generally by the numeral 62, which applies a covering of low density polyethylene over the corrugated metal shield 18. As can be seen in FIG. 3, portions of the corrugations of the metal shield 18 protrude into the polyethylene inner jacket 21. The single jacketed core is preferably advanced through a short distance in the ambient atmosphere and then into and through a water trough 63 to cool the jacket.

In the next step of a preferred embodiment of the process, the partially completed cable 10 is advanced through a second extruder, designated generally by the numeral 70, in tandem with the extruder 62, which applies a polybutylene outer jacket 26 over the polyethylene inner jacket 21. The dual jacketed cable 10 is moved through a second water trough 71, past the capstan 52 and taken up on a reel 75. The polybutylene material is extruded at a higher temperature than the polyethylene, for example, a die temperature of 475° F versus 425° F for the polyethylene.

At line speeds of approximately 50 feet per minute, the cable 10 may require approximately 10 feet of travel in the water trough prior to the polybutylene jacketing material being cooled from the semi-molten state. Moreover, as the cable 10 is advanced along a path of travel through the water trough 71, it should be appreciated that the cable is not disposed linearly but includes sags therealong as among points of support such as trough openings and the trough bottom. This may cause ripples in the surface of the jacket 26. With the polybutylene jacket material still in semi-molten form, the sag causes a greater corrugation imprint, e.g., 25 mils, on the lower portion of the cable than on the upper, e.g., 5 mils. Moreover, the accentuated imprinting brought on by the sags is periodic. The adverse effects of the cooling trough 71 are mitigated by using a substantially deeper trough than normal so that the jacket 26 has cooled substantially before sagging into engagement with the trough bottom.

While the inner jacket 21 could be extruded onto the shielded core 11, taken up and then advanced along another line whereat the outer jacket 26 is extruded thereover, tandem extrusion of the two jackets is preferred. The taking up of the polyethylene-jacketed core 11 with imprinting thereof prior to applying the outer jacket 26 would cause somewhat severe stretching of the outwardly facing portions of the inner jacket especially on the smaller diameter inner convolutions on the take-up reel (not shown). Then, when the single jacketed core 11 is run through the outer jacket line, the partially completed cable, linearly disposed, tends to cause a buckling of the inner jacket 21. This is avoided by tandem extrusion, which also provides obvious manufacturing economies.

While the preferred embodiment of the cable 10 includes an inner jacket 21 constructed of a low density polyethylene material and an outer jacket 26 constructed of a polybutylene material, the invention is not so restricted.

It is not without the scope of this invention to provide a cable 10 in which the inner jacket 21 and the outer jacket 26 are constructed of materials which differ from those of the preferred embodiment. What is important is that the material of the outer jacket 26 be capable of withstanding the elevated temperatures discussed herein, the inner jacket 21 having the strength to permit the integrity of the cable jacket to be maintained notwithstanding the imprinting thereof and the stresses induced therein during the installation of the cable in underground ducts.

On the other hand, the inner jacket 21 must present a smooth outer surface for subsequent application of the polybutylene outer jacket 26. Preferably the inner jacket 21 is constructed with a low notch sensitivity material such as, for example, polyethylene.

It has been found that in a cable 10 constructed in accordance with the principles of this invention, that the polyethylene and polybutylene jackets, for example, do not bond chemically to each other. The question may arise as to whether a severe installation, e.g. tortuous path, could cause the outer jacket 26 to be pulled form the cable. Tests have demonstrated that in excess of 600 pounds of pull must be exerted before the dual jackets 21 and 26 begin to be pulled from the corrugated steel layer 18. Moreover, almost 1000 pound pull is required to cause slippage between the inner jacket 21 and the outer jacket 26. During the curing of the polybutylene, the crystalline transformation thereof causes the outer jacket 26 to shrink and become engaged tightly with the outwardly facing surface of the inner jacket 21. The use of polypropylene-petroleum jelly flooding compound may reduce this latter force by as much as 43% at 75° F. This may be overcome by using a thermoplastic flooding compound.

It is to be understood that the above-described arrangements are simply illustrative of the invention. Other arrangements may be devised by those skilled in the art which will embody the principles of the invention and fall within the spirit and scope thereof.

What is claimed is:

1. A cable, which comprises:

a core;

a corrugated metallic shield surrounding the core and having an outwardly facing major surface and an inwardly facing major surface which faces the core; and an extruded covering of polymeric material which surrounds and is in intimate contact with at least portions of the outwardly facing major surface of the metallic shield, and which includes:

an outer layer comprising a material which is capable of withstanding exposure to temperatures of at least 212° F; and an inner layer interposed between the outer layer and the corrugated metallic shield and having a thickness at least slightly greater than the depth of the corrugations of the metallic shield and comprising a material having a notch sensitivity which is substantially less than that of the material of the outer layer to maintain the structural integrity of the cable notwithstanding corrugation imprint of the inner layer by the metallic shield.

2. The cable of claim 1, wherein the percent elongation of the material which comprises the inner layer is not reduced substantially by the corrugations of the metallic layer protruding thereinto a distance which may be at least approximately 30 percent of the thickness of the inner layer with the cable at a temperature at least as low as 40° F.

3. The cable of claim 1, wherein the material of the outer layer is capable of resisting rupture at temperatures of at least 212° F while maintaining a gas pressure within the cable core of at least 10 p.s.i.

4. The cable of claim 1, wherein the inner layer is high molecular weight low density polyethylene and the outer layer is polybutylene.

5. The cable of claim 4, wherein the cable includes a corrosion preventive material in engagement with portions of the corrugated shield adjacent the core and filling approximately one-half the depth of the outwardly facing valleys of the corrugations, and the inner layer being in engagement with the corrosion-preventive material.

6. A cable which comprises:

a core;

a first metallic layer surrounding the core and having inwardly and outwardly facing major surfaces with the inwardly facing major surface facing the core;

a second metallic layer surrounding the first metallic layer and having inwardly and outwardly facing corrugated major surfaces with the inwardly facing surface facing the outwardly facing major surface of the first metallic layer and with longitudinal portions of the second layer forming an overlapped longitudinal seam in which overlapping portions are bonded together;

a corrosion-preventive material covering at least portions of the outwardly facing surface of the second metallic layer and filling partially the corrugations thereof;

an inner jacket of an extruded polymeric material in intimate contact with the covered outwardly facing surface of the second metallic layer and having a thickness at least slightly greater than the depth of the corrugations of the second metallic layer, the material of the inner jacket experiencing no appreciable change in percent elongation at a temperature of at least as low as 40° F when having a cut thereacross to a depth at least approximately 30% of the thickness; and an outer jacket of an extruded polymeric material surrounding the inner jacket in intimate contact therewith and capable of withstanding exposure to temperatures at least as high as 212° F without degrading the cable.

* * * * *